US007066672B2

(12) United States Patent
Murata et al.

(10) Patent No.: US 7,066,672 B2
(45) Date of Patent: Jun. 27, 2006

(54) TAPE PRINTING APPARATUS HAVING IMPACT PROTECTOR MEMBER

(75) Inventors: Susumu Murata, Nagoya (JP); Shin Manabe, Nagoya (JP); Kazuyoshi Minaminaka, Suzuka (JP); Shigeru Matsumoto, Toyokawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/862,415

(22) Filed: Jun. 8, 2004

(65) Prior Publication Data

US 2005/0002716 A1 Jan. 6, 2005

(30) Foreign Application Priority Data

Jul. 3, 2003 (JP) ..... 2003-191355

(51) Int. Cl.
*B41J 29/00* (2006.01)

(52) U.S. Cl. ..... 400/693; 400/88; 400/621

(58) Field of Classification Search ..... None
See application file for complete search history.

(56) References Cited

U.S. PATENT DOCUMENTS

| | | | | |
|---|---|---|---|---|
| 4,768,230 | A | 8/1988 | Viebrantz et al. | 398/106 |
| 5,758,980 | A * | 6/1998 | Takenaka | 400/611 |
| 6,676,314 | B1 | 1/2004 | Tanaka et al. | |
| 6,968,161 | B1 | 11/2005 | Inomata et al. | |
| 2001/0009627 | A1 | 7/2001 | Huggines et al. | 400/621 |
| 2003/0031494 | A1 | 2/2003 | Cockerill et al. | 400/615.2 |

FOREIGN PATENT DOCUMENTS

| | | | |
|---|---|---|---|
| EP | 0 832 753 | A1 | 4/1998 |
| JP | 08009448 | A * | 1/1996 |
| JP | 09-254450 | | 9/1997 |
| JP | 10-070375 | A | 3/1998 |
| JP | 11-240209 | A | 9/1999 |
| JP | 11-274747 | A | 10/1999 |
| JP | 2000013044 | A * | 1/2000 |
| JP | 2001-102767 | A | 4/2001 |
| JP | 2001-251400 | A | 9/2001 |
| JP | 2001353927 | A * | 12/2001 |
| JP | 2003-063071 | A | 3/2003 |
| WO | WO 95/14366 | | 5/1995 |

OTHER PUBLICATIONS

Machine translation of JP 2001-353927 to Obara from Japanese Patent Office website.*
Machine translation of JP 08-009448 to Kiyono from Japanese Patent Office website.*

* cited by examiner

*Primary Examiner*—Daniel J. Colilla
(74) *Attorney, Agent, or Firm*—Oliff & Berridge, PLC

(57) ABSTRACT

A tape printing apparatus is provided which allows a tape cassette or battery to be replaced easily without removing a protector when the tape cassette or battery is replaced. The first protector member which covers a first end section of each of the upper unit of the main body, the lower unit of main body and the cover member to protect the tape printing apparatus and the second protector member located at a second end section for covering the second end section is separated between the main body and the cover member.

28 Claims, 6 Drawing Sheets

TAPE PRINTING APPARATUS HAVING IMPACT PROTECTOR MEMBER

BACKGROUND OF THE INVENTION

1. Field of Invention

The present invention relates to a tape printing apparatus having a tape cassette and a battery accommodating section and more particularly to a tape printing apparatus in which protector members for protecting the tape printing apparatus is constructed of components so as to enable replacement of the tape cassette and battery when that the protector members are mounted.

2. Description of Related Art

In the related art there are portable tape printing apparatus, which accommodate a tape cassette containing tape, incorporate a battery and, through a drive motor, drive a platen roller so as to advance the tape through a printing device and then to discharge the tape to the outside of the tape printing apparatus.

For example, Japanese Patent Application Laid-Open No. 9-254450 discloses a tape printing apparatus with a control board and a tape cassette disposed on an inside face of a case and arranged to overlap vertically. A cutout section is formed laterally in the control board and a drive motor is disposed in this cutout section. A power circuit and plural batteries are accommodated in parallel in a battery accommodating section on a side opposite to the side in which the drive motor is disposed within the case.

In this tape printing apparatus, there is no space formed between the tape cassette and the battery accommodating section and consequently, there is no need to increase the length of the control board or to increase the size of the case. Thus, the tape printing apparatus can be formed shorter and compact. Further, the drive motor may be disposed on one side in the length direction of the case and the battery accommodating section may be provided on the other side. The drive motor and battery are heavy components. As a result, the weight of the case is balanced and not deflected to one side when an input operation is carried out when the case is held by the hand of a user. This improves the operability.

If a display of the tape printing apparatus is placed on one side in the width direction of the control board and the cutout section in which this drive motor should be disposed is located next to the display, the dimension in the length direction of the control board can be shorter. Thus, the dimension in the length direction of the tape printing apparatus becomes shorter, and the entire size of the tape printing apparatus is made compact.

SUMMARY OF THE INVENTION

However, the portable tape printing apparatus described above has no shield for protecting itself when it drops on the ground. It is important to protect the apparatus because it is transported to various places as it can be carried with the hand. For this reason, portable tape printing apparatus should be provided with a protector member to protect itself from impact due to being dropped. However, if the entire apparatus is covered with the protector to protect itself, the protector member needs to be removed each time a tape cassette or battery accommodated therein is replaced. Because removing the protector member needs to be carried out often and under unstable conditions, the replacement work is troublesome.

One object of the present invention is to provide a tape printing apparatus which allows a tape cassette or battery to be replaced easily without removing a protector member, although the tape printing apparatus is covered with the protector member.

To achieve the above and/or other objects, according to an aspect of the present invention, there is provided a tape printing apparatus having a main unit which has an upper unit and a lower unit, the upper unit including a keyboard section in which keys for inputting characters and the like are arranged, a display, such as a liquid crystal display for displaying characters and the like; the lower unit provided with a cassette accommodating section to accommodate a tape cassette containing tape, a print head for printing characters and the like input through the keys on the tape from the tape cassette and mounted under the upper unit of the main body; and a cover member mounted detachably on a bottom of the lower unit of the main body and for opening/closing the cassette accommodating section. The tape printing apparatus may also include: a first protector member for covering a first end section of each of the upper unit of the main body, the lower unit of main body and the cover member; and a second protector member for covering a second end section of the upper unit of the main body, the lower unit of the main body and the cover member located opposite to the first end section. The first protector member and the second protector member preferably are separated into two sections between the main body and the cover member.

With this structure, the first protector member and the second protector member may be mounted separately to the main body and the cover member. Thus, with the first protector member and the second protector member mounted on the tape printing apparatus, the cover member can be removed from the bottom face of the lower unit of the main body.

Therefore, the tape cassette can be replaced easily without removing the first protector member and the second protector member.

According to another aspect of the present invention, there is provided a tape printing apparatus having a main unit which has an upper unit and a lower unit, the upper unit including a keyboard section in which keys for inputting characters and the like are arranged, a display for displaying characters and the like; the lower unit provided with a cassette accommodating section including a tape cassette containing tape, a print head for printing characters and the like input through the keys on a tape from the tape cassette and mounted under the upper unit of the main body; and a cover member mounted detachably on a bottom of the lower unit of the main body and for opening/closing the cassette accommodating section. The tape printing apparatus may also include: grip members disposed on opposite sides of the lower unit of the main body; a top section of the grip members being nipped between a bottom edge of the upper unit of the main body and a top edge of the lower unit of the main body, a bottom section of the grip members being nipped between a step section formed on the lower unit of the main body and the top edge of the cover member.

With this structure, the grip members are able to be fixed. Consequently, the grip members are difficult to remove during normal usage, and if the cover member is removed from the lower unit of the main body, and then the upper unit of the main body and the lower unit of the main body are separated for recycling, the grip members are released from their fixed condition and can be easily removed.

According to another aspect of the present invention, there is provided a tape printing apparatus having a main unit which has an upper unit and a lower unit, the upper unit including a keyboard section in which keys for inputting characters and the like are arranged and a display for displaying characters and the like; the lower unit provided with a cassette accommodating section including a tape cassette containing tape, a print head for printing characters and the like input through the keys on a tape from the tape cassette and mounted under the upper unit of the main body; and a cover member mounted detachably on a bottom of the lower unit of the main body and for opening/closing the cassette accommodating section. The tape printing apparatus may also include: grip members disposed on opposite sides of the lower unit of the main body; a first protector member for covering a first end section of each of the upper unit of the main body, the lower unit of the main body and the cover member; and a second protector member for covering a second end section of the upper unit of the main body, the lower unit of the main body and the cover member located opposite to the first end section, the first protector member covering a first end section of the grip members, and the second protector member covering a second end section of the grip members.

With this structure, when the first protector member and the second protector member are mounted on the tape printing apparatus, the section on which the grip member is attached is not increased in dimension by the first protector member and the second protector member. Thus, the ability of a user to grip the tape printing apparatus is not hampered.

In this tape printing apparatus, a top section of the grip member may be nipped between a bottom edge of the upper unit of the main body and a top edge of the lower unit of the main body, while a bottom section of the grip member may be nipped by a step section formed on the lower unit of the main body and a top edge of the cover member so that the grip members are fixed.

As a result, the grip members are difficult to separate during normal usage, and if the cover member is removed from the lower unit of the main body, and the upper unit of the main body and the lower unit of the main body are separated from each other for recycling, the grip members are released from their fixed condition and can be easily removed.

Further, the first protector member and second protector member may be two separate sections between the main body and the cover member.

Because the first protector member and the second protector member are separate between the main body and the cover member, the cover member can be removed from the bottom face of the lower unit of the main body while the first protector member and the second protector member remain mounted on the tape printing apparatus. Thus, the tape cassette can be replaced easily without removing the first protector member and the second protector member.

Further, concave attachment sections on which the grip member is to be attached may be provided on both sides of the lower unit of the main body, while the surface of the grip member forms a continuous plane with the surface of the lower unit of the main body in the surrounding. Consequently, there is no fear that the finger of a user may be caught by an end section of the grip member.

Further, the first protector member, the second protector member and the grip member may be formed of elastomer.

Thus, the first protector member and the second protector member absorb impact when the tape printing apparatus is dropped on the ground and damage is reduced or prevented. Further, the grip member has an effect of reducing slippage, so that an operator can grip it easily.

Preferably, the lower unit of the main body further contains a battery accommodating section for accommodating a battery, and the cover member opens/closes the cassette accommodating section and the battery accommodating section. Thus, the replacement of the tape cassette and battery is facilitated by commonizing the cover member for the cassette accommodating section and the battery accommodating section.

Preferably, engagement sections for engaging/disengaging a cover member with/from the bottom face of the lower unit of the main body are provided on end sections of the cover member. The first protector member covers the engagement section while a surface of the engagement section of the cover member is formed lower than the surface of the first protector member.

Thus, when the tape printing apparatus is dropped on the ground, the first protector member is impacted before the engagement section of the cover member. Therefore, there is no fear that the cover member may become loose.

Further, the first protector member and second protector member may cover the upper unit of the main body, the lower unit of the main body and the cover member using a removable type adhesive agent. Thus, the respective components can be disassembled without adherence of the adhesive agent on each component.

BRIEF DESCRIPTION OF THE DRAWINGS

Objects, features and advantages of the invention will become more apparent from reading the following description of exemplary embodiments taken in connection with the accompanying drawings in which.

DETAILED DESCRIPTION OF EXEMPLARY EMBODIMENTS

Figure 1:
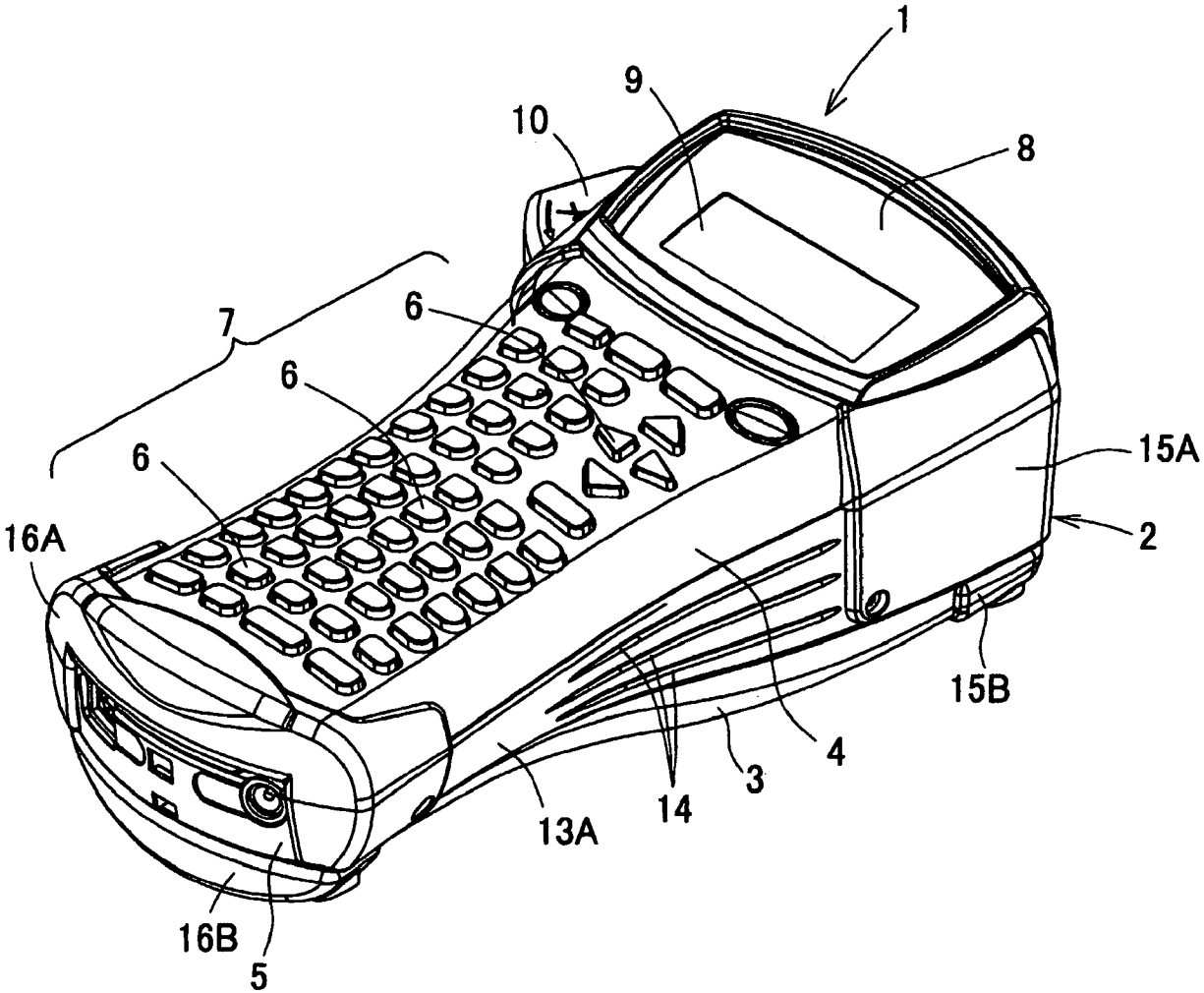
FIG. 1 is a schematic perspective view of a tape printing apparatus of an exemplary embodiment of the present invention.

Hereinafter, an exemplary embodiment of the tape printing apparatus of the present invention will be described in detail with reference to the accompanying drawings. First, a schematic structure of the tape printing apparatus of this embodiment will be described with reference to FIGS. 1 and 2. FIG. 1 is a perspective view showing an entire tape printing apparatus and FIG. 2 is a perspective view showing the rear side of the tape printing apparatus.

Figure 2:
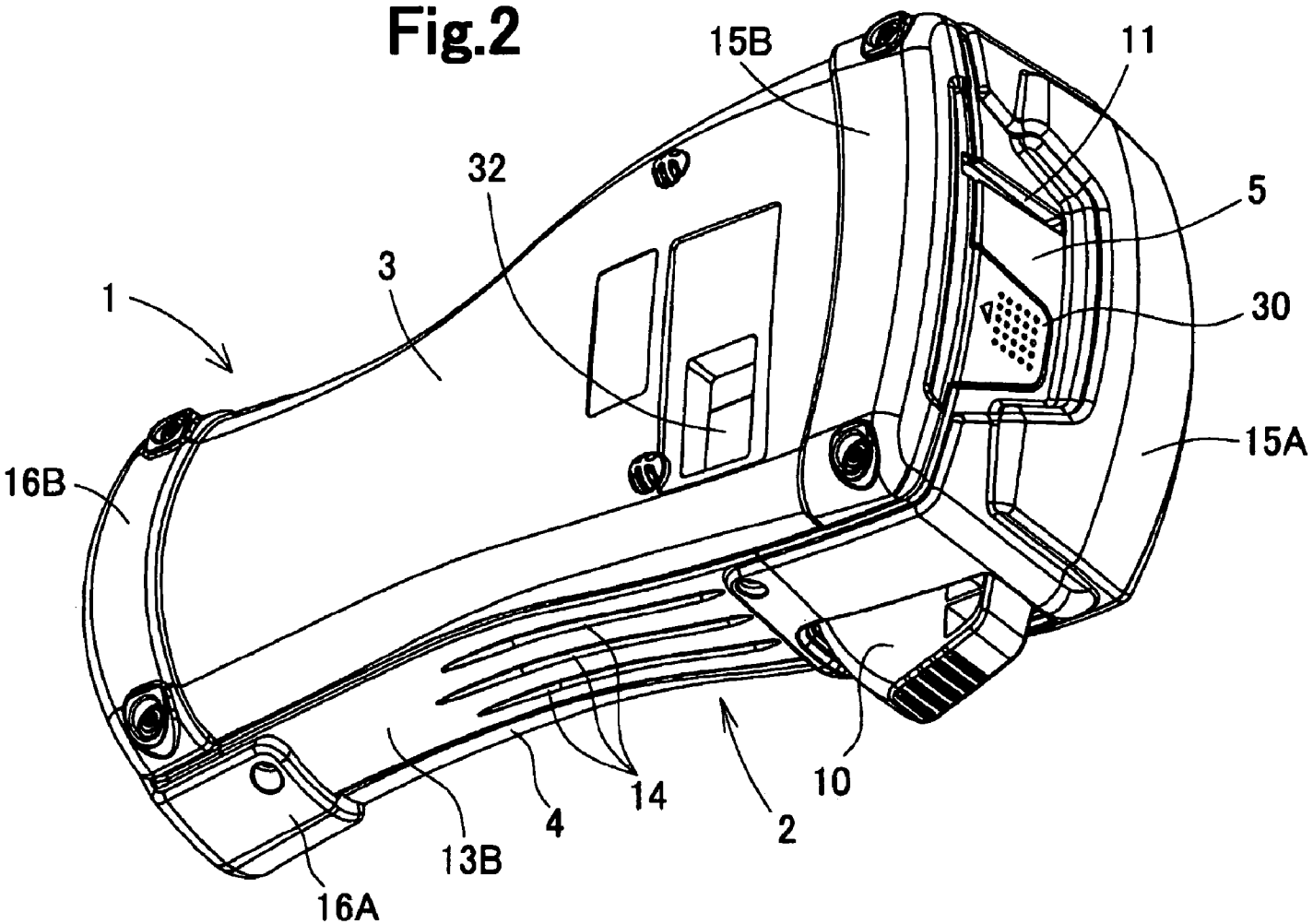
FIG. 2 is a schematic perspective view of a rear side of the tape printing apparatus of the embodiment of the present invention.

As shown in FIGS. 1 and 2, the tape printing apparatus 1 has a main body 2 made of any suitable material such as polystyrene and a rear cover 3 made of any suitable material such as polystyrene mounted detachably so as to cover the entire rear face (a face opposite to a face opposing a user when the tape printing apparatus 1 is used) of this main body 2. The main body 2 has an upper unit 4 of the main body and a lower unit 5 of the main body. The upper unit 4 has a keyboard section 7 in which various kinds of keys 6 for inputting characters and the like are disposed on the surface in the center thereof while a window section 8 is disposed in the right/left direction substantially in the center of the surface on its top face. A display such as a liquid crystal display 9 for displaying characters and the like input through the keys 6 is disposed in this window section 8.

A cutter lever 10 is provided on the left side face of the display 9 of the main body 2. By pressing this cutter lever 10 inward with the thumb or other finger, a thermal tape 12 (see FIG. 3) discharged from a tape discharge port 11 formed at a top end section can be cut out with a cutter (not shown). The tape 12 has an image receiving layer on which characters are printed and an adhesive layer and a separation layer for protecting the adhesive surface.

The lateral width of the upper unit 4 of main body having the keyboard section 7 is formed a little smaller than the lateral width of a section having the window section 8. Grip members 13A, 13B are attached to both sides of the lower unit 5. The grip members 13A, 13B may be formed of a styrene base elastomer resin having elasticity, which reduces or prevents slippage, and constructed so that it is easy to handle with the hand of an operator. Because the grip members 13A, 13B are mounted on the same plane as the main body 2 and the rear cover 3 as described later, there is no fear that the finger may be caught by an end section of the grip members 13A, 13B. Further, three rows of protrusions 14 are formed on the surface of the grip members 13A, 13B to help reduce or prevent slippage. The grip members 13A and 13B may be collectively referred to as grip member 13.

A method for mounting the grip members 13A, 13B to the tape printing apparatus 1 will be described later.

The tape printing apparatus 1 has a first protector member 15A, 15B for covering the end section provided with the display 9 and a second protector member 16A, 16B, which is formed separately from the first protector member 15A, 15B, for covering an end section on an opposite side to the end section provided with the display 9. The respective protector members 15A, 15B, 16A, 16B may be constructed separately. A first protector member 15A and a second protector member 16A are attached to the upper unit of main body 4 and the lower unit of main body 5, while a first protector member 15B and a second protector member 16B are attached to the rear cover 3 respectively.

Further, because the protector members 15A, 15B, 16A, 16B may be formed of styrene base elastomer resin having elasticity like the aforementioned grip member 13, it reduces an impact which may occur when the tape printing apparatus 1 is dropped, thereby protecting the exterior face of the apparatus from damage.

A method for mounting the first and second protector members 15A, 15B, 16A, 16B onto the tape printing apparatus 1 will be described later.

Figure 3:
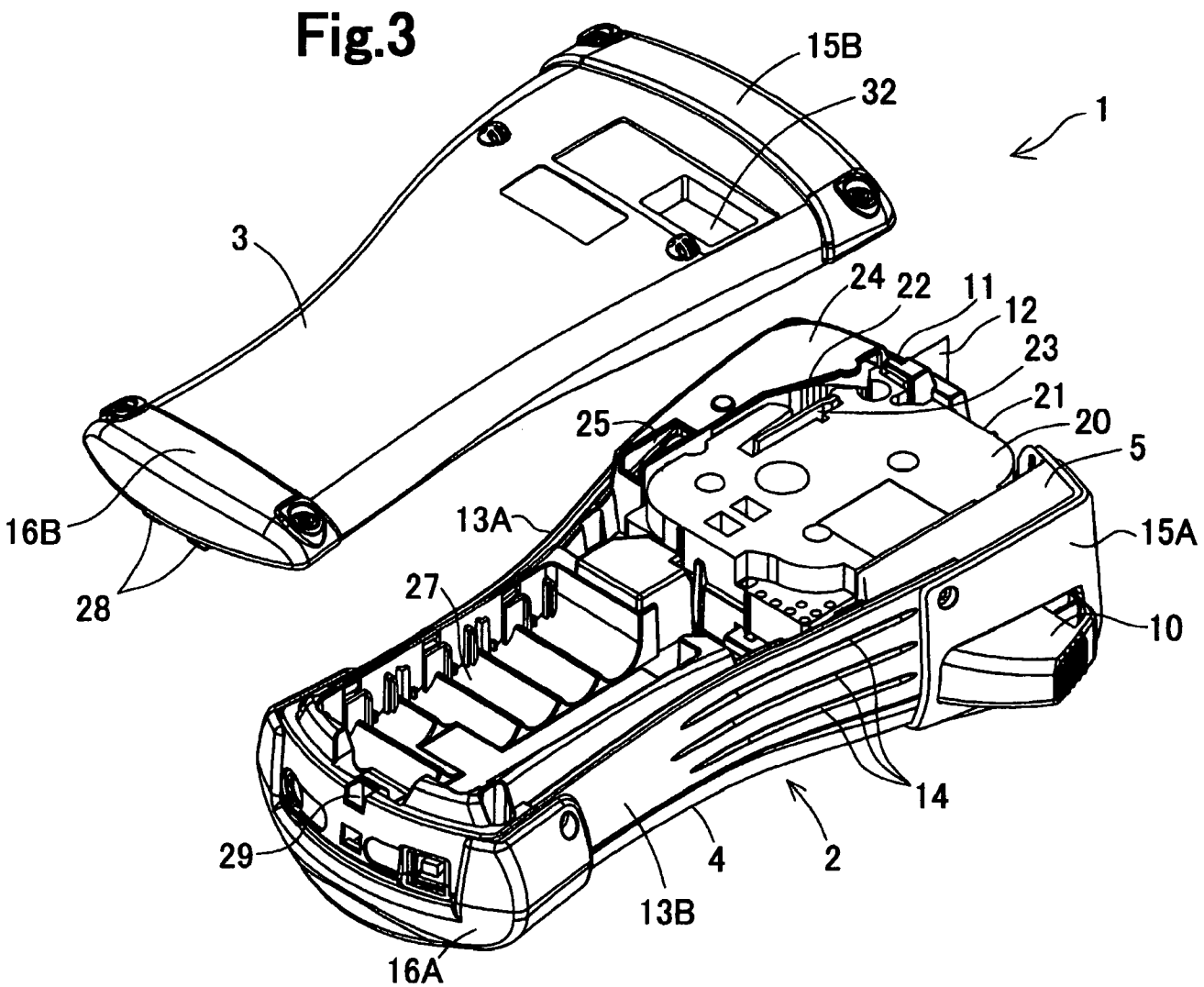
FIG. 3 is a perspective view of an interior of a lower unit of a main body of the tape printing apparatus of the embodiment of the present invention.

Next, an interior structure of the lower unit of main body 5 will be described with reference to FIG. 3. FIG. 3 is a perspective view showing the tape printing apparatus 1 when the rear cover 3 is detached as viewed from the rear side.

As shown in FIG. 3, the lower unit 5 is provided with a cassette accommodating section 21 which is substantially rectangular to match the external shape of the tape cassette 20 and has a depth to match the thickness of the tape cassette 20. In the vicinity of an end section on the cutter lever 10 side of this cassette accommodating section 21 is erected a thin thermal head mounting section 23, on which the thermal head 22 is mounted. Further, a platen holder (not shown) is provided rotatably at a drive section 24 provided on the side portion of the cassette accommodating section 21 opposing the thermal head 22.

When the rear cover 3 is mounted on a bottom face of the lower unit 5, a projection section 26 (see FIG. 4) provided on an inside face of the rear cover 3 is inserted into an engagement hole 25 in the drive section 24, so that the platen holder is rotated to the side of the thermal head 22. Further, the platen holder is rotated to the side of the tape cassette 20 up to a position in which part of the tape 12 of the tape cassette 20 is pressed against the thermal head 22 to print character on the tape 12. Then, the printed tape 12 is carried through the thermal head 22 and discharged from the tape discharge port 11.

A battery accommodating section 27 in which batteries are accommodated is formed on an opposite side to the side provided with the cassette accommodating section 21 of the lower unit 5, such that it is projected from a bottom face of the cassette accommodating section 21.

When the rear cover 3 is attached to the bottom of the lower unit 5, first insertion sections 28 formed at an end on the side in which the second protector member 16B is provided are inserted into an insertion groove 29 in the lower unit 5 and after that, a pawl section 31 (see FIG. 4) of a second insertion section 30 provided on an opposite side to the first insertion section 28 is engaged with a pawl fixing section (not shown) provided on the lower unit 5, so that the rear cover 3 is attached. If the second insertion section 30 is pressed inwardly with the rear cover 3 attached, the pawl section 31 is released from the pawl fixing section, so that the rear cover 3 can be attached to/detached from the lower unit 5 easily. With the rear cover 3 removed, the tape cassette 20 can be taken out upward of the cassette accommodating section 21. Batteries accommodated in the battery accommodating section 27 can be taken out successively and replaced. At that time, the rear cover 3 can be opened/closed with the respective protector members 15A, 15B, 16A, 16B mounted on the tape printing apparatus 1 because the first and second protector members 15A, 15B, 16A, 16B are constructed separately with respect to the upper unit 4, the lower unit 5 and the rear cover 3 as described above.

A check window 32 is provided in a section opposing the tape cassette 20 accommodated in the lower unit 5 of the rear cover 3, and the protector member 15B is attached to the rear cover 3 without covering the check window 32. Therefore, the type of a tape cassette 20 accommodated in the cassette accommodating section 21 can be confirmed through the check window 32 without opening the rear cover 3.

As shown in FIG. 2, at a section covering a top face on the side of the display 9 of the tape printing apparatus 1, the first protector member 15A is shaped so the tape discharge port 11 and the second insertion section 30 of the rear cover 3 are not covered. Consequently, the first protector member 15A does not obstruct discharge of the tape 12. Further, when the rear cover 3 is removed from the lower unit 5, an operation of pressing the second insertion section 30 inwardly is not obstructed. Therefore, a printed tape 12 can be discharged from the tape discharge port 11 with the first protector member 15A mounted and further, the rear cover 3 can be removed from the lower unit 5 by pressing the second insertion section 30 inwardly.

When the first protector member 15A is installed on the upper unit 4 and the lower unit 5, the surface of the second insertion section 30 is lower than the surface of the first protector member 15A. Thus, if the tape printing apparatus 1 is dropped on the ground, there is little risk of the second insertion section 30 being pressed inwardly so that the rear cover 3 is advertently removed, because the first protector member 15A makes contact with the ground or the like earlier than the second insertion section 30.

Figure 4:
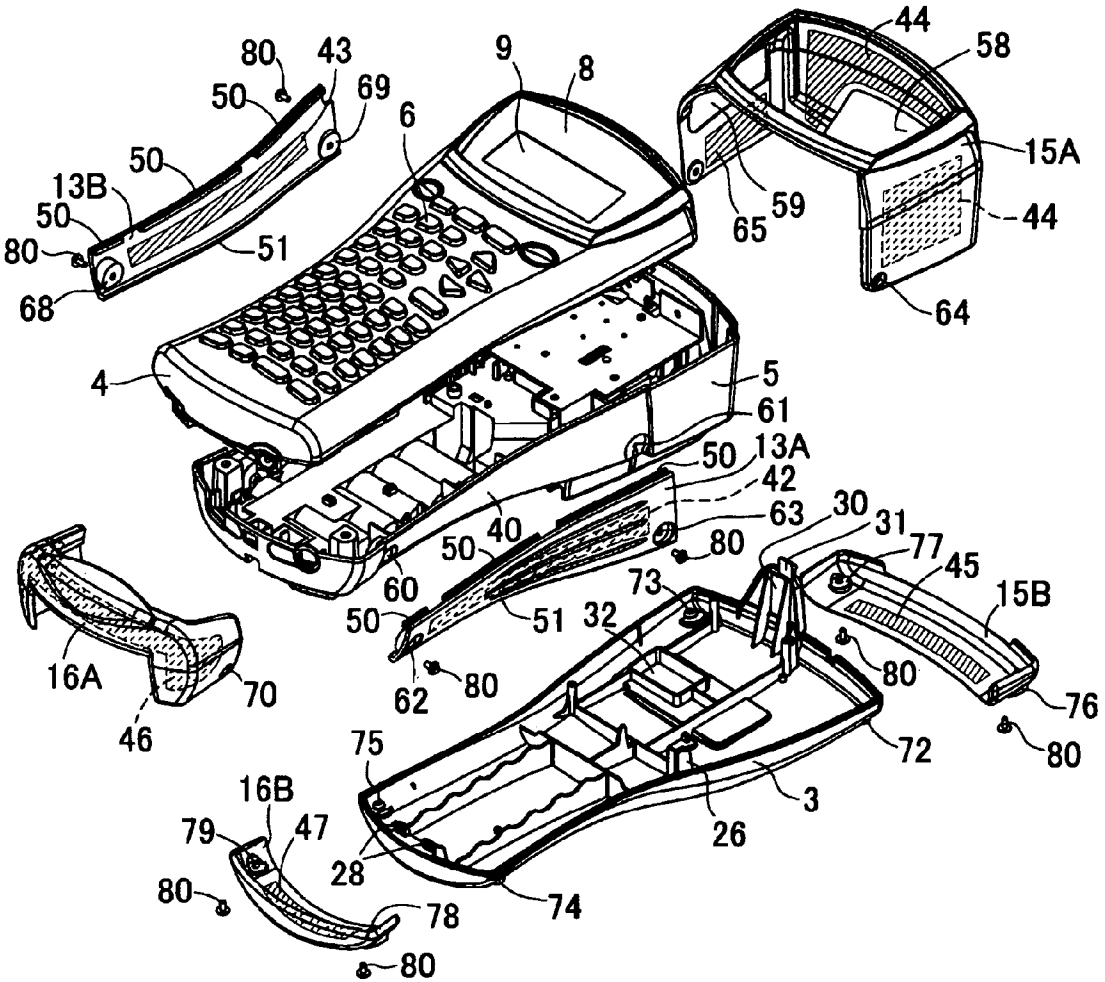
FIG. 4 is an explanatory diagram showing a method for mounting a protector member and a grip member of the tape printing apparatus of the embodiment of the present invention.
Figure 5:
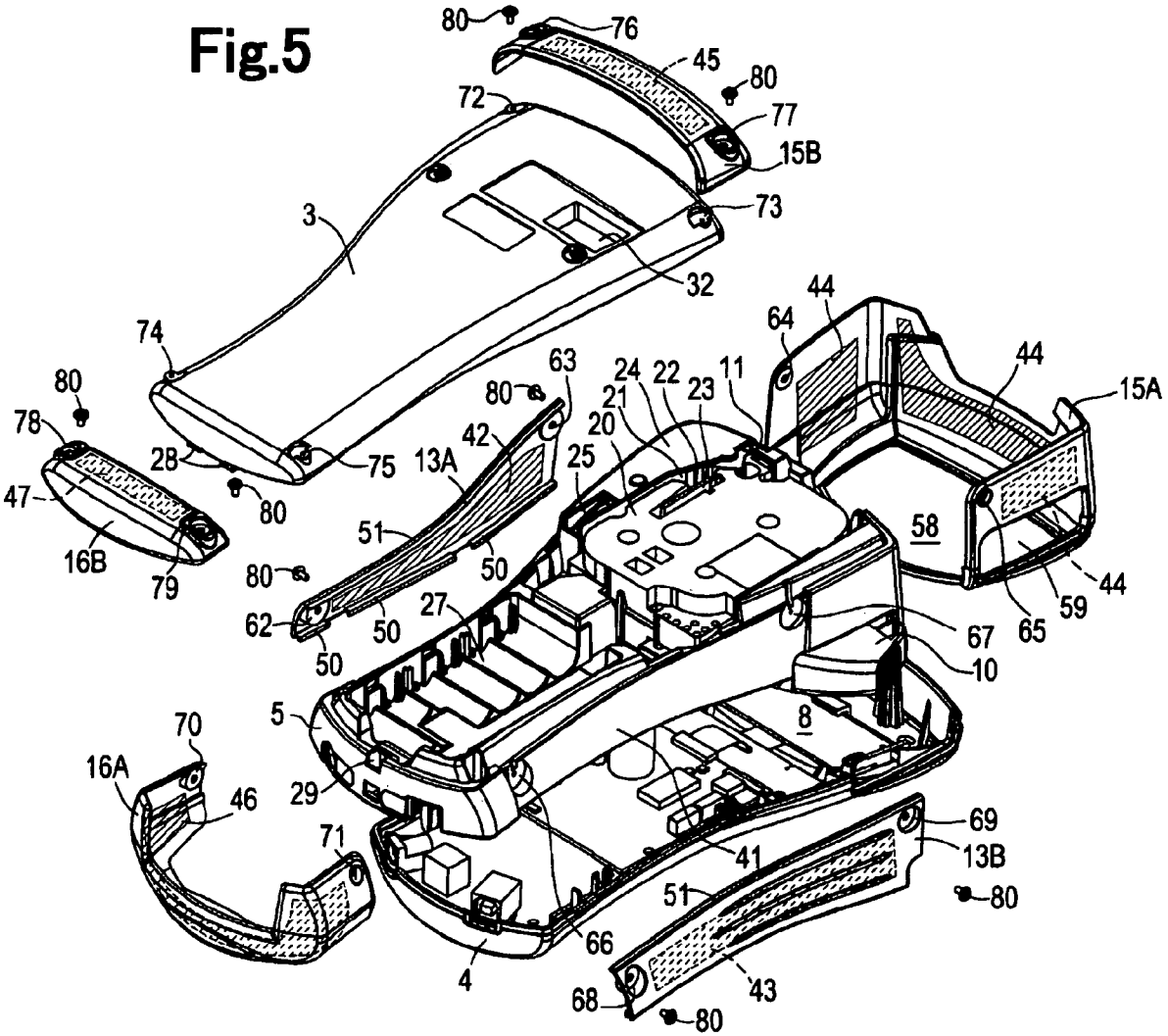
FIG. 5 is an explanatory diagram showing a method for mounting a protector member and a grip member when viewed from the rear side of the tape printing apparatus of the embodiment.
Figure 6:
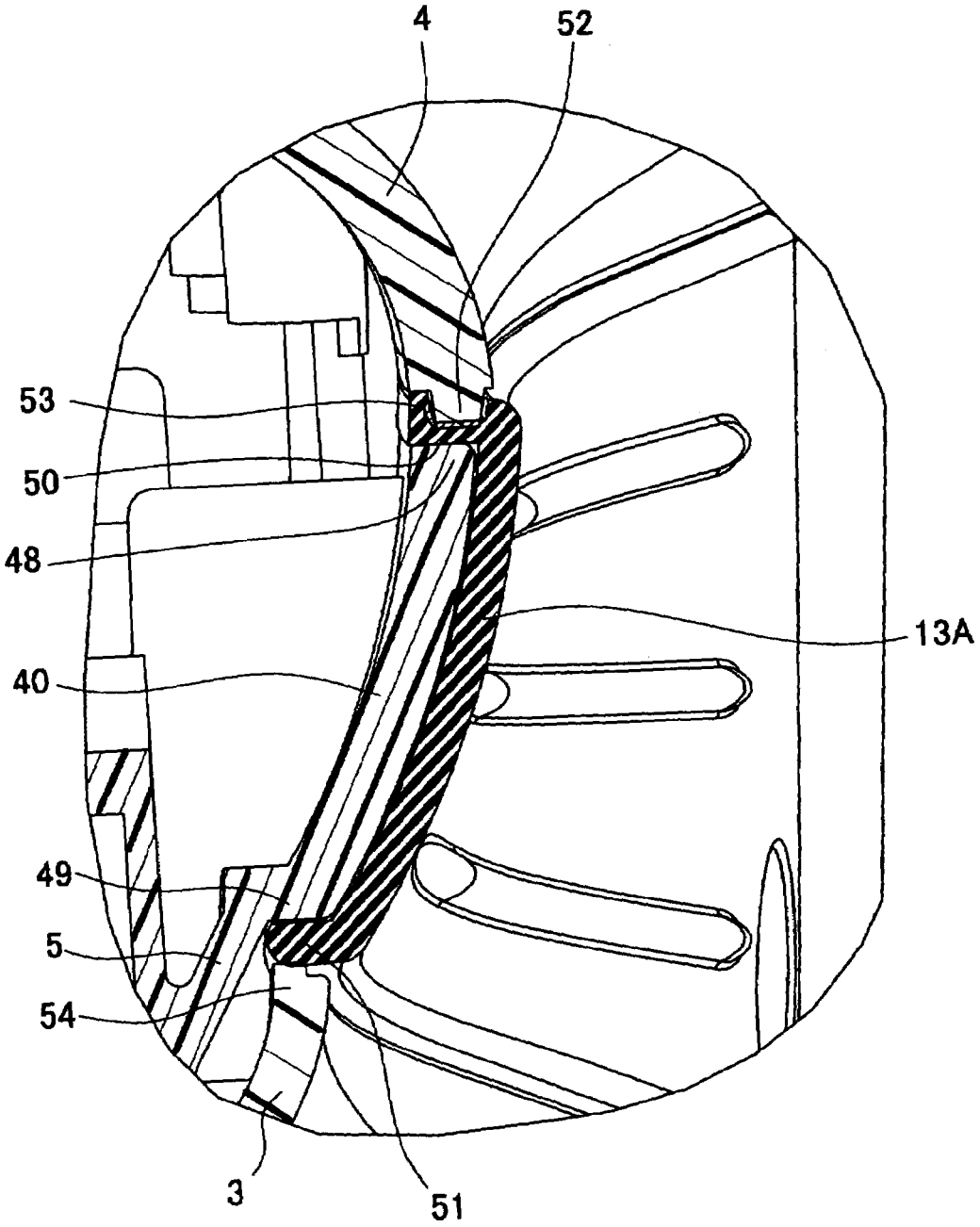
FIG. 6 is a sectional view of the grip member mounted on the tape printing apparatus of the embodiment.

Next, a method for mounting the grip members 13A, 13B, the first protector members 15A, 15B and the second protector members 16A, 16B on the tape printing apparatus 1 will be described with reference to FIGS. 4–6. FIG. 4 is an explanatory diagram showing the method for mounting the grip members 13A, 13B, the first protector members 15A, 15B and the second protector members 16A, 16B on the tape printing apparatus 1 as viewed from the front side thereof. FIG. 5 is an explanatory diagram showing the method for mounting the grip members 13A, 13B, the first protector members 15A, 15B and the second protector members 16A, 16B onto the tape printing apparatus 1 as viewed from the rear side thereof. FIG. 6 is a cross-sectional diagram of the grip members 13A, 13B mounted on the tape printing apparatus 1.

Attachment sections 40, 41 for attaching the grip members 13A, 13B are provided on both sides from the cassette accommodating section 21 up to the battery accommodating section 27 in the lower unit 5 in the tape printing apparatus 1. The attachment sections 40, 41 are formed in a concave shape and in such a depth and size that the surfaces of the grip members 13A, 13B form a continuous plane with the surfaces of the lower unit 5 and upper unit 4 around the attachment sections 40 and 41. Circular first engagement sections 60, 61 in which a screw hole is formed in the center thereof are provided on both ends of the attachment section 40. Also, second engagement sections 62, 63 in which a screw hole is formed in the center thereof are provided at a position corresponding to the first engagement sections 60, 61 of the grip member 13A. The first engagement sections 66, 67, which are similar to the first engagement sections 60, 61, are provided in the attachment section 41. Second engagement sections 68, 69, which are similar to the second engagement sections 62, 63, are provided in the grip member 13B. First engagement pieces 50 are formed in the center and both ends on the top face of the grip members 13A, 13B and second engagement pieces 51 are formed on a bottom of the grip members 13A, 13B along ends thereof.

When the grip member 13A is attached to the tape printing apparatus 1, first, a double-sided tape 42 is bonded to an inside face of the grip member 13A, which makes contact with the attachment section 40. Then, the grip member 13A is bonded to the attachment section 40 with the double-sided tape 42. At this moment, by engaging the first engagement sections 60, 61 with the second engagement sections 62, 63, they can be positioned easily. Double-sided tapes 42, 43, 44, 45, 46, 47 used in this embodiment use removable type adhesive agent, so that they can be peeled off easily without any adhesive agent left on the bonding surface even after a long-time of usage.

When the grip member 13A is bonded to the attachment section 40 with the double-sided tape 42, the first engagement piece 50 formed on a top of the grip member 13A keeps in contact with a top edge 48 of the lower unit 5 formed in the attachment section 40 (see FIG. 6). After the grip member 13A is attached to the attachment section 40 with double-sided tape, when the upper unit 4 is mounted on the lower unit 5, the first engagement pieces 50 are nipped and fixed by a bottom edge 52 of the upper unit 4 and an upper edge 48 of the lower unit 5. The second engagement piece 51 formed on the bottom of the grip member 13A is kept in contact with a step 49 of the lower unit 5 formed on the attachment section 40. Thus, when the rear cover 3 is attached to the lower unit 5 after the grip member 13A is bonded, the second engagement piece 51 is nipped and fixed by the step 49 of the lower unit 4 and an upper edge 54 of the rear cover 3.

When the first engagement piece 50 is nipped by the lower edge 52 of the upper unit 4 and the upper edge 48 of the lower unit 5, an engagement pawl 53 provided upward at a front end of the first engagement piece 50 makes contact with an inside face of the lower edge 52 of the upper unit 4, so that the first engagement piece 50 is securely fixed.

Consequently, the grip member 13A is attached to the tape printing apparatus 1. The grip member 13B has basically the same structure as the grip member 13A and is attached to the tape printing apparatus 1 in the same way as described above. Therefore, description of that matter is omitted.

Although as described previously, the rear cover 3 is mounted detachably to the lower unit 5 for replacement of the tape cassette 20 or the battery, usually, a user does not need to remove the upper unit 4 from the lower unit 5. Thus, even when the rear cover 3 is removed during normal usage, the top sections of the grip members 13A, 13B are always nipped. Therefore, when the rear cover 3 is removed, the grip members 13A, 13B do not become separated from the attachment sections 40, 41. Further, because by forming the attachment sections 40, 41 in a concave configuration, the grip members 13A, 13B, the main body 2 and the rear cover 3 form a continuous plane, there is no fear that the grip members 13A, 13B become separated when a finger is caught by an end section of each of the grip members 13A, 13B.

A method for mounting the first protector member 15A and the second protector member 16A to the tape printing apparatus 1 will be described below. Third engagement sections 64, 65 having a screw hole in the center are provided at two positions on both sides of corners of the first protector member 15A. By forming cutout sections 58, 59 at positions corresponding to the window section 8 and the cutter lever 10, characters shown on the display 9 provided in the window section 8 are kept from being hidden when the first protector member 15A is mounted and further, the operation of the cutter lever 10 is not blocked.

When the first protector member 15A and the second protector member 16A are mounted, initially, the upper unit 4 and the lower unit 5 are joined and the grip members 13A, 13B are attached as described previously. In this condition, the double-sided tape 44 is attached to an inside face of the first protector member 15A and bonded to the main body 2 such that it covers the window section 8. At that time, the first protector member 15A is positioned by engagement of the third engaging sections 64, 65 with the second engaging sections 63, 69 formed in the grip members 13A, 13B. A screw 80 is inserted into a screw hole provided in each of the third engaging sections 64, 65 and tightened. Consequently, the first engaging sections 61, 67, the second engaging sections 63, 69 and the third engaging sections 64, 65 are fixed with the screws 80, so that the first protector member 15A is mounted on the tape printing apparatus 1. The grip members 13A, 13B are also fixed to the attachment sections 40, 41 when the screw 80 is tightened. Thus, the grip members 13A, 13B can be fixed securely to the tape printing apparatus 1 without tightening any other screws. As a result, part of the first protector member 15A covers end sections of the grip members 13A, 13B on the side of the liquid crystal display 9. Thus, there is no risk that a user's finger may be caught by the end sections of the grip members 13A, 13B on the side of the display 9.

The second protector member 16A also is attached with the double-sided tape 46 in the same way as described above and the first engaging sections 60, 66, the second engaging sections 62, 68 and the third engaging sections 70, 71 also are fixed when the screws 80 are tightened, so that they are installed on the tape printing apparatus 1. Consequently, part of the second protector member 16A covers end sections on opposite sides of the display 9 of the grip members 13A, 13B. Thus, there is no risk that a user's finger may be caught by the end section of the grip members 13A, 13B on the opposite side to the display 9.

Next, a method for mounting the first protector member 15B and the second protector member 16B to the tape printing apparatus 1 will be described. First engaging sections 72, 73, 74, 75 having a screw hole in the center thereof are formed at four corners of the rear cover 3. Second engaging sections 76, 77, 78, 79 having a screw hole in the center thereof are provided at both end sections of the first protector member 15B and the second protector member 16B.

After the double-sided tape 45 is attached to the inside face of the first protector member 15B, it is bonded to a corner provided with the second insertion section 30 of the rear cover 3. At this time, the first protector member 15B is positioned when the first engaging sections 72, 73 engages the second engaging sections 76, 77. Then, the first engaging sections 72, 73 are fixed with the second engaging sections 76, 77 when the screws 80 are tightened through the screw holes provided in the second engaging sections 76, 77, so that the first protector member 15B is mounted.

The second protector member 16B also is bonded with the double-sided tape 47 in the same way as described previously, and by tightening the screw 80, the first engaging sections 74, 75 are fixed with the second engaging sections 78, 79, so that the second protector member 16B is installed on the tape printing apparatus 1.

The first protector members 15A, 15B and the second protector members 16A, 16B are installed to an end section on the side of the display 9 and the other end section on an opposite side of each of the upper unit 4, the lower unit 5 and the rear cover 3. Consequently, the first protector members 15A, 15B only overlap the ends of each of the grip members 13A, 13B. Thus, when the first protector members 15A, 15B and the second protector members 16A, 16B are installed, sections in which the grip members 13A, 13B are installed are not increased in thickness, thereby maintaining a user's ability to grip the tape printing apparatus 1.

In the tape printing apparatus 1 of this embodiment, as described above, the first protector members 15A, 15B, and the second protector members 16A, 16B, are mounted separately. The grip members 13A, 13B are provided on both sides of the lower unit 5 and the first engagement piece 50 provided on the top section of each of the grip members 13A, 13B is nipped by the bottom edge 52 of the upper unit 4 and a top edge 48 of the lower unit 5 while the second engagement piece 51 provided on the bottom section of each of the grip members 13A, 13B is nipped by a step section 49 of the lower unit 5 and the top edge 54 of the rear cover 3 so as to fix the grip members 13A, 13B. Consequently, with the first protector members 15A, 15B and the second protector members 16A, 16B loaded on the tape printing apparatus 1, the rear cover 3 can be removed from the main body 2. Therefore, when replacing the tape cassette 20 or the battery, this can be accomplished without removing the protector members 15A, 15B, 16A, 16B.

Because the grip members 13A, 13B are nipped by the upper unit 4 and the lower unit 5 so that they are fixed, there is no risk that they may become loose during normal usage. For recycling, they can be removed easily by separating the upper unit 4 and the lower unit 5. The double-sided tape used for bonding uses removable type adhesive agent and thus, can be peeled off easily even if a long time elapses after it is bonded. No adhesive agent is left after it is peeled off. Because the attachment sections 40, 41 provided on the lower unit 5, on which the grip members 13A, 13B are to be attached, are formed in concave configuration with respect to the surrounding, the grip members 13A, 13B forms a continuous plane with the main body 2 and the rear cover 3 when they are attached, thereby preventing the grip members 13A, 13B from being caught by a user's finger or the like and detached.

The grip members 13A, 13B and the first/second protector members 15A, 15B, 16A, 16B reduce impact when the tape printing apparatus 1 is dropped on the ground and have an effect of reducing or preventing the slippage so that they are easy to grip because the grip members 13A, 13B and the first/second protector members 15A, 15B; 16A, 16B may be formed of styrene base elastomer resin having elasticity. Further, because the main body 2, the rear cover 3 and the double-sided tapes 42, 43, 44, 45, 46, 47 are of polystyrene as their base, the grip members 13A, 13B and the first/second protector members 15A, 15B, 16A, 16B can be recycled even if they are not removed from the tape printing apparatus 1, thereby ensuring high recycle performance.

Although in the tape printing apparatus 1 of this embodiment, the grip members 13A, 13B and the first/second protector members 15A, 15B, 16A, 16B may be formed of styrene base elastomer resin, they may be formed of other elastic material, for example, silicone rubber or other rubber.

Although in the tape printing apparatus 1 of this embodiment, the first protector member 15A and the second protector member 16A to be installed on the upper unit of main body 4 and the lower unit of main body 5 are formed separately, both the members may be combined and formed integrally. At that time, an opening is formed in each of sections opposing the keyboard section 7 so as to expose the keyboard section 7.

Further, although the first protector member 15B and the second protector member 16B to be installed on the rear cover 3 are formed separately, both the members may be combined and formed integrally. That is, the front face of the rear cover 3 except the check window 32 may be covered with the protector member.

Further, the first protector member 15A and the second protector member 16A may be formed integrally with the grip members 13A, 13B.

Because according to the first aspect of the present invention, the first protector member 15A, 15B, which covers part of each of the upper unit 4, lower unit 5 and rear cover 3 to protect the tape printing apparatus 1 and the second protector member 16A, 16B located on an opposite end for covering the other end section, are mounted separately between the main body 2 and the rear cover 3, the rear cover 3 can be removed from the bottom face of the lower unit 5 with the first protector member 15A, 16B and the second protector member 16A, 16B mounted on the tape printing apparatus 1. Thus, the tape cassette 20 can be replaced easily without removing the first protector member 15A, 15B and the second protector member 16A, 16B.

Because according to the second aspect of the present invention, the grip members 13A, 13B are provided on both sides of the lower unit 5, and the top section of each grip member is nipped by the bottom edge of the upper unit 4 and the top edge 48 of the lower unit 5, while the bottom section of the grip members 13A and 13B are nipped by the step section 49 on the lower unit 5 and the top edge of the rear cover 3 so as to fix the grip members 13A, 13B, the grip members 13A, 13B are difficult to separate during normal usage. If the rear cover 3 is removed from the lower unit 5 and then the upper unit 4 and the lower unit 5 are separated from each other for recycling, the grip members 13A, 13B are released from the fixed condition and can be removed easily.

Because according to the third aspect of the present invention, the first protector member 15A, 15B covers an end section of each of the grip members 13A, 13B, and the second protector member 16A, 16B covers the other end section of the grip members 13A, 13B, the section on which the grip members 13A, 13B are mounted does not increase in thickness, and the tape printing apparatus 1 is easy to grip.

Because according to the fourth aspect of the present invention, the grip members 13A, 13B are provided on both sides of the lower unit 5, and the top section of each grip member 13A, 13B is nipped by the bottom edge of the upper unit 4 and the top edge of the lower unit 5, while the bottom section of each grip member 13A, 13B is nipped by the step section 49 on the lower unit 5 and the top edge of the rear cover 3, so as to fix the grip members 13A, 13B, the grip members 13A, 13B are difficult to separate during normal usage. If the rear cover 3 is removed from the lower unit 5, and then the upper unit 4 and the lower unit 5 are separated from each other for recycling, the grip members 13A, 13B are released from the fixed condition and can be removed easily.

Because according to the fifth aspect of the present invention, the first protector member 15A, 15B and the second protector member 16A, 16B are separated between the main body 2 and the rear cover 3, the rear cover 3 can be removed from the bottom face of the lower unit 5 with the first protector member 15A, 15B and the second protector member 16A, 16B mounted on the tape printing apparatus 1. Thus, the tape cassette 20 can be replaced easily without removing the first protector member 15A, 15B and the second protector member 16A, 16B.

Because according to the sixth aspect of the present invention, the concave attachment sections 40, 41 on which the grip members 13A, 13B are to be attached are provided on both sides of the lower unit 5, the surface of the grip members 13A, 13B and the surface of the lower unit 5 form a continuous plane. Therefore, there is no risk that a user's finger may be caught by the end section of the grip member 13A, 13B and that the grip members 13A, 13B may become loose.

Because according to the seventh aspect of the present invention, the first protector member 15A, 15B, the second protector member 16A, 16B and the grip members 13A, 13B are formed of elastomer, an impact when the tape printing apparatus 1 is dropped on the ground is reduced by the first protector member 15A, 15B and the second protector member 16A, 16B thereby protecting the tape printing apparatus from damage. Further, the grip members 13A, 13B have an effect of reducing slippage so that an operator can grip the tape printing apparatus 1 easily.

Because according to the eighth aspect of the present invention, the lower unit 5 contains the battery accommodating section 27 for accommodating batteries as well as the cassette accommodating section 21, and the rear cover opens/closes the cassette accommodating section 21 and the battery accommodating section 27, the replacement of the tape cassette 20 and the battery is facilitated by using a common rear cover for the cassette accommodating section 21 and the battery accommodating section 27.

Because according to the ninth aspect of the present invention, the second insertion section 30 for engaging/disengaging the rear cover with/from the bottom face of the lower unit 5 is provided at an end section of the rear cover, and the first protector member 15A, 15B covers the second insertion section 30 when it is installed on the tape printing apparatus, so that the surface of the second insertion section 30 of the cover member is formed lower than the surface of the first protector member 15A, 15B, when the tape printing apparatus 1 is dropped on the ground, the first protector member 15A, 15B impacts instead of the section insertion section 30 of the rear cover 3, thereby eliminating a fear that the rear cover may become loose.

Because according to the tenth aspect of the present invention, the first protector member 15A, 15B and the second protector member 16A, 16B cover the upper unit 4, the lower unit 5 and the rear cover 3 by using removable type adhesive agent, the respective members may be disassembled without adherence of the adhesive agent.

The invention is not limited to the illustrated embodiment in which protector members are provided on each end of the tape printer. A single protector member could be provided for the entire printer. Alternatively, a protector member for only one end (or only one portion) of the tape printer could be provided. In addition, it is not necessary for a protector member to be completely separated into two separate pieces (like pieces 15A and 15B). For example, two portions of the protector member could be movably attached to each other by a hinge portion so that the cover member can be swung open about the hinge. In this example, the cover member can be opened without removing the protector member, as in the illustrated embodiment.

While the invention has been described with reference to exemplary embodiments, it is to be understood that the invention is not limited to the exemplary embodiments or constructions. While the various elements of the exemplary embodiments are shown in various combinations and configurations, which are exemplary, other combinations and configurations, including more, less or only a single element, are also within the spirit and scope of the invention.

What is claimed is:

1. A tape printing apparatus, comprising:

a main body having an upper unit and a lower unit;

the upper unit including an input section and a display;

the lower unit provided with a cassette accommodating section to accommodate a tape cassette containing a tape, and a print head for printing information input through the input section on a tape pulled out from the tape cassette and mounted under the upper unit;

a cover member mounted detachably on a bottom of the lower unit and for opening/closing the cassette accommodating section;

a first protector member covering a first end section of each of the upper unit, the lower unit and the cover member; and a second protector member covering a second end section, located opposite to the first end section, of the upper unit, the lower unit and the cover member, the first protector member and the second protector member being separated into two sections between the main body and the cover member.

2. The tape printing apparatus according to claim 1, wherein the first protector member and the second protector member are formed of an elastomer.

3. The tape printing apparatus according to claim 1, wherein the lower unit includes a battery accommodating section for accommodating at least one battery and the cover member opens/closes the cassette accommodating section and the battery accommodating section.

4. The tape printing apparatus according to claim 1, wherein an engagement section for engaging/disengaging the cover member with/from a bottom face of the lower unit is provided at an end section of the cover member, and the first protector member covers the engagement section, and a surface of the engagement section of the cover member is lower than a surface of the first protector member.

5. The tape printing apparatus according to claim 1, wherein the first protector member and the second protector member are attached by a removable adhesive agent, and cover the upper unit, the lower unit and the cover member.

6. A tape printing apparatus, comprising:

an upper unit including an input section and a display;

a lower unit provided with a cassette accommodating section to accommodate a tape cassette containing a tape and a print head for printing information input through the input section on a tape pulled out from the tape cassette and mounted under the upper unit;

a cover member mounted detachably on a bottom of the lower unit and for opening/closing the cassette accommodating section;

grip members disposed on opposite sides of the lower unit;

a top section of the grip members being nipped between a bottom edge of the upper unit and a top edge of the lower unit, a bottom section of the grip members being nipped between a step section formed on the lower unit and the top edge of the cover member.

7. The tape printing apparatus according to claim 6, wherein concave attachment sections on which the grip members are to be attached are provided on both sides of the lower unit, while the surface of the grip members form a continuous plane with the surface of the lower unit adjacent the concave attachment sections.

8. The tape printing apparatus according to claim 6, wherein the grip members are formed of an elastomer.

9. The tape printing apparatus according to claim 6, wherein the lower unit further comprises:

a battery accommodating section for accommodating at least one battery, and the cover member opens/closes the cassette accommodating section and the battery accommodating section.

10. A tape printing apparatus comprising:

an upper unit including an input section and a display;

a lower unit provided with a cassette accommodating section to accommodate a tape cassette containing a tape and a print head for printing information input through the input section on a tape pulled out from the tape cassette and mounted under the upper unit;

a cover member mounted detachably on a bottom of the lower unit of main body and for opening/closing the cassette accommodating section;

grip members disposed on opposite sides of the lower unit;

a first protector member covering a first end section of each of the upper unit, the lower unit and the cover member; and a second protector member covering a second end section located opposite to the first end section of the upper unit, the lower unit and the cover member, the first protector member covering first end sections of the grip members and the second protector member covering second end sections of the grip members.

11. The tape printing apparatus according to claim 10, wherein a top section of the grip member is nipped between a bottom edge of the upper unit and a top edge of the lower unit, while a bottom section of the grip member is nipped by a step section formed on the lower unit of main body and a top edge of the cover member.

12. The tape printing apparatus according to claim 11, wherein the first protector member and the second protector member are separated into two sections between the main body and the cover member.

13. The tape printing apparatus according to claim 10, wherein the first protector member and the second protector member are separated into two sections between the main body and the cover member.

14. The tape printing apparatus according to claim 10, wherein concave attachment sections on which the grip members are attached are provided on both sides of the lower unit, while the surface of the grip members form a continuous plane with the surface of the lower unit adjacent to the concave attachment sections.

15. The tape printing apparatus according to claim 10, wherein the first protector member, the second protector member and the grip members are formed of an elastomer.

16. The tape printing apparatus according to claim 10, wherein the lower unit further comprises:

a battery accommodating section for accommodating at least one battery, and the cover member opens/closes the cassette accommodating section and the battery accommodating section.

17. The tape printing apparatus according to claim 10, wherein engagement sections for engaging/disengaging a cover member with/from the bottom face of the lower unit of the main body are provided on an end section of the cover member, and the first protector member covers the engagement section, while the surface of the engagement section of the cover member is formed lower than the surface of the first protector member.

18. The tape printing apparatus according to claim 10, wherein the first protector member and the second protector member cover the upper unit, the lower unit and the cover member using a removable adhesive agent.

19. A tape printing apparatus comprising:

a main body having an input section, a display and an internal chamber that accommodates a removable component of the tape printing apparatus;

a cover member mounted detachably to the main body to cover an opening on the main body through which the internal chamber is accessed;

a protector member having a first portion provided on the main body, and a second portion provided on the cover member, the first and second portions are movable relative to each other so that the cover member can be opened to access the internal chamber without removing the protector member; and an engagement section for releasably engaging the cover member with the main body provided at an end of the cover member, and the protector member covers a surface of the engagement section, and a surface of the engagement section of the cover member is lower than a surface of the protector member.

20. The tape printing apparatus according to claim 19, wherein the internal chamber holds a removable tape cassette.

21. The tape printing apparatus according to claim 19, wherein the internal chamber holds a removable battery.

22. The tape printing apparatus according to claim 20, wherein the internal chamber also holds a removable battery.

23. The tape printing apparatus according to claim 19, wherein the protector member covers a first end of the main body and a first end of the cover member.

24. The tape printing apparatus according to claim 19, wherein the protector member is a first protector member that covers a first end of the main body and a first end of the cover member, and further comprising a second protector member that covers a second end of the main body and a second end of the cover member, the second end is opposite of the first end.

25. The tape printing apparatus according to claim 24, wherein the second protector member is separated between the main body and the cover member.

26. The tape printing apparatus according to claim 19, wherein the protector member is formed of an elastomer.

27. The tape printing apparatus according to claim 19, wherein the protector member is attached by a removable adhesive agent to the main body and to the cover member.

28. The tape printing apparatus according to claim 19, wherein the first portion of the protector member is completely separated from the second portion of the protector member.

* * * * *